US009618216B2

(12) United States Patent
Kashihara et al.

(10) Patent No.: US 9,618,216 B2
(45) Date of Patent: Apr. 11, 2017

(54) AIR CONDITIONING APPARATUS

(71) Applicant: DAIKIN INDUSTRIES, LTD., Osaka-shi, Osaka (JP)

(72) Inventors: Takashi Kashihara, Sakai (JP); Tsunehisa Sanagi, Sakai (JP); Takahiro Yamasaki, Sakai (JP); Naofumi Yokoyama, Sakai (JP); Tsuyoshi Yokomizo, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 44 days.

(21) Appl. No.: 14/687,202

(22) Filed: Apr. 15, 2015

(65) Prior Publication Data

US 2015/0300669 A1 Oct. 22, 2015

(30) Foreign Application Priority Data

Apr. 18, 2014 (JP) ..... 2014-086208

(51) Int. Cl.
*E04H 1/14* (2006.01)
*F24F 1/00* (2011.01)

(52) U.S. Cl.
CPC ..... *F24F 1/0022* (2013.01); *F24F 1/0018* (2013.01)

(58) Field of Classification Search
USPC ..... 454/249
IPC ..... F24F 1/0022,1/0018, 2023/1056, 2023/106, 2023/1064
See application file for complete search history.

(56) References Cited

U.S. PATENT DOCUMENTS

2005/0109054 A1* 5/2005 Eom ..... F24F 1/0007 62/286
2008/0070493 A1* 3/2008 Rimmer ..... F24F 1/0007 454/186

FOREIGN PATENT DOCUMENTS

JP 6-281194 A 10/1994

* cited by examiner

*Primary Examiner* — Helena Kosanovic
(74) *Attorney, Agent, or Firm* — Global IP Counselors

(57) ABSTRACT

An air conditioning apparatus includes a casing having intake and blow-out ports, a partition member dividing an interior of the casing, a heat exchanger, and a centrifugal fan. The blow-out port is at least partially disposed adjacent to a blow-out port nearby lateral part of the casing along an opening direction of a fan entrance and the blow-out port. A fan downwind space is located on a downwind side of a bladed wheel within a fan compartment, and has a blow-out port opposed space and a blow-out port non-opposed space. A first guide member directs air existing in the blow-out port non-opposed space toward the blow-out port opposed space, and is mounted in a boundary region located astride of regions located on forward and rearward sides in a rotary direction within the blow-out port non-opposed and blow-out port opposed spaces, respectively.

11 Claims, 12 Drawing Sheets

AIR CONDITIONING APPARATUS

CROSS-REFERENCE TO RELATED APPLICATIONS

This application claims priority under 35 U.S.C. §119 to Japanese Patent Application No. 2014-086208, filed Apr. 18, 2014. The entire disclosure of Japanese Patent Application No. 2014-086208 is hereby incorporated herein by reference.

FIELD OF THE INVENTION

The present invention relates to an air conditioning apparatus, particularly to an air conditioning apparatus that a rearward bladed centrifugal fan is mounted in a fan compartment having a fan entrance bored in opposition to a blow-out port such that a rotary shaft of the centrifugal fan is oriented to an opening direction of the fan entrance and an opening direction of the blow-out port.

BACKGROUND INFORMATION

As described in Japan Laid-open Patent Application Publication No. H06-281194, an air conditioning apparatus has been produced so far that a rearward bladed centrifugal fan is mounted in a ventilation unit (a fan compartment) having a fan entrance bored in opposition to a blow-out port such that a rotary shaft of the centrifugal fan is oriented to an opening direction of the fan entrance and an opening direction of the blow-out port. In the air conditioning apparatus, when a unit case (a casing) is seen from a direction along a direction of the rotary shaft of the centrifugal fan, the blow-out port is disposed so as to be located in the middle of the casing. Furthermore, air blown out by the bladed wheel is directed to flow closely to the middle of the casing by a wind guide plate, and is configured to be fed to the outside of the casing from the blow-out port.

SUMMARY

When the casing is herein seen from the direction along the direction of the rotary shaft of the centrifugal fan, air blown out by the bladed wheel of the centrifugal fan tends to swirl in a rotary direction of the bladed wheel and simultaneously flow along the lateral parts of the casing. Therefore, as described in Patent Literature 1, the construction for directing air blown out by the bladed wheel of the centrifugal fan to flow closely to the middle of the casing can be interpreted as forcibly changing the airflow that air blown out by the bladed wheel of the centrifugal fan swirls and flows along the lateral parts of the casing. Put differently, the construction of Japan Laid-open Patent Application Publication No. H06-281194 does not well consider the flow tendency of air blown out from the rearward bladed centrifugal fan that is mounted in the fan compartment such that the rotary shaft is oriented to the opening direction of the fan entrance and the opening direction of the blow-out port. Thus, the construction cannot be interpreted as being designed to sufficiently enhance the ventilation performance of the centrifugal fan. Consequently, it is demanded to enhance the ventilation performance of the centrifugal fan in consideration of the flow tendency of air blown out from the centrifugal fan.

It is an object of the present invention to enhance the ventilation performance of a centrifugal fan in an air conditioning apparatus that a rearward bladed centrifugal fan is mounted in a fan compartment having a fan entrance bored in opposition to a blow-out port such that a rotary shaft of the centrifugal fan is oriented to an opening direction of the fan entrance and an opening direction of the blow-out port.

An air conditioning apparatus according to a first aspect includes a casing, a partition member, a heat exchanger and a centrifugal fan. The casing has an intake port and a blow-out port. The partition member divides an interior of the casing into a heat exchanger compartment located on an intake port side and a fan compartment located on a blow-out port side, and has a fan entrance that is bored in opposition to the blow-out port and makes the heat exchanger compartment and the fan compartment communicate with each other. The heat exchanger is mounted in the heat exchanger compartment. The centrifugal fan includes a bladed wheel having a plurality of rearward blades and is configured to suck air existing in the heat exchanger compartment into the fan compartment through the fan entrance, with the bladed wheel being mounted in the fan compartment such that a rotary shaft of the bladed wheel is oriented to an opening direction of the fan entrance and an opening direction of the blow-out port. Furthermore, the blow-out port is at least partially disposed in a position close to a blow-out port nearby lateral part, which is one of lateral parts of the casing that are disposed along the opening direction of the fan entrance and the opening direction of the blow-out port. The fan compartment includes a fan downwind space. The fan downwind space is a space located on a downwind side of the bladed wheel within the fan compartment, and has a blow-out port opposed space and a blow-out port non-opposed space. The blow-out port opposed space is a region opposed to the blow-out port within the fan downwind space, whereas the blow-out port non-opposed space is a region opposed not to the blow-out port but to a blow-out port non-opposed surface part within the fan downwind space. The blow-out port non-opposed surface part is opposed to the fan entrance in a position located on the downwind side of the bladed wheel. Additionally, the air conditioning apparatus includes a first guide member for directing air existing in the blow-out port non-opposed space toward the blow-out port opposed space. The first guide member is mounted in a boundary region located astride a region located on a forward side in a rotary direction of the bladed wheel within the blow-out port non-opposed space and a region located on a rearward side in the rotary direction of the bladed wheel within the blow-out port opposed space.

As described above, at least a part of the blow-out port is herein designed to be disposed closely to the blow-out port nearby lateral part, and the first guide member is designed to be mounted in the boundary region located astride the region located on the forward side in the rotary direction of the bladed wheel within the blow-out port non-opposed space and the region located on the rearward side in the rotary direction of the bladed wheel within the blow-out port opposed space. With the construction, ventilation resistance can be herein reduced in the fan compartment by promoting the swirling flow of air blown out by the bladed wheel of the centrifugal fan.

Consequently, the ventilation performance of the centrifugal fan can be herein more enhanced than a well-known configuration for directing air blown out by the bladed wheel of the centrifugal fan to flow closely to the middle of the casing.

An air conditioning apparatus according to a second aspect relates to the air conditioning apparatus according to the first aspect, and wherein the first guide member has a first guide body that is formed along a shape of the blow-out port non-opposed surface part and is disposed away from the blow-out port non-opposed surface part at an interval.

As described above, the first guide body of the first guide member is herein formed along the shape of the blow-out port non-opposed surface part, and is disposed away from the blow-out port non-opposed surface part at an interval. With the construction, air existing in the blow-out port non-opposed space is herein configured to be directed toward the blow-out port opposed space through a region between the first guide body and the blow-out port non-opposed surface part.

Consequently, air existing in the blow-out port non-opposed space can be herein smoothly directed toward the blow-out port opposed space.

An air conditioning apparatus according to a third aspect relates to the air conditioning apparatus according to the second aspect, and wherein the first guide body gradually curves toward the blow-out port in a direction from the blow-out port non-opposed space to the blow-out port opposed space when seen from a direction orthogonal to the rotary shaft.

As described above, the first guide body of the first guide member herein curves toward the blow-out port when seen from the direction orthogonal to the rotary shaft. With the construction, air existing in the blow-out port non-opposed space is herein directed toward the blow-out port opposed space and is easily directed toward the blow-out port.

Consequently, air existing in the blow-out port non-opposed space can be herein easily directed to the blow-out port through the blow-out port opposed space.

An air conditioning apparatus according to a fourth aspect relates to the air conditioning apparatus according to any one of the first to third aspects, and wherein the first guide member is disposed so as to overlap with the bladed wheel when seen from a direction along the rotary shaft.

As described above, when seen from the direction along the rotary shaft, the first guide member is herein designed to be disposed so as to overlap with the bladed wheel. With the construction, air existing in the blow-out port non-opposed space can be herein reliably directed toward the blow-out port opposed space.

Consequently, the ventilation performance of the centrifugal fan can be herein reliably enhanced.

An air conditioning apparatus according to a fifth aspect relates to the air conditioning apparatus according to any one of the first to fourth aspects, and further includes a second guide member mounted in the blow-out port opposed space for directing air toward the blow-out port after the air is directed to the blow-out port opposed space.

As described above, the second guide member is herein designed to be provided as well as the first guide member. With the construction, after directed to the blow-out port opposed space by the first guide member, air can be herein further directed toward the blow-out port by the second guide member.

Consequently, air can be herein smoothly directed to the blow-out port after directed to the blow-out port opposed space.

An air conditioning apparatus according to a sixth aspect relates to the air conditioning apparatus according to the fifth aspect, and wherein the second guide member has a second guide body that extends toward the blow-out port so as to continue from a blow-out port side end of the first guide member.

As described above, the second guide body of the second guide member is herein designed to extend toward the blow-out port so as to continue from the blow-out port side end of the first guide member. With the construction, air is herein easily directed toward the blow-out port through the second guide member after directed to the blow-out port opposed space by the first guide member.

Consequently, air existing in the blow-out port non-opposed space can be herein easily directed to the blow-out port through the blow-out port opposed space.

BRIEF DESCRIPTION OF THE DRAWINGS

Referring now to the attached drawings which form a part of this original disclosure.

DETAILED DESCRIPTION OF EMBODIMENTS

An air conditioning apparatus according to a preferred embodiment of the present invention will be hereinafter explained on the basis of the attached drawings. It should be noted that a specific construction of the air conditioning apparatus according to the present invention is not limited to the following preferred embodiment and the modifications thereof, and can be changed without departing from the scope of the present invention.

(1) Basic Construction of Air Conditioning Apparatus

Figure 1:
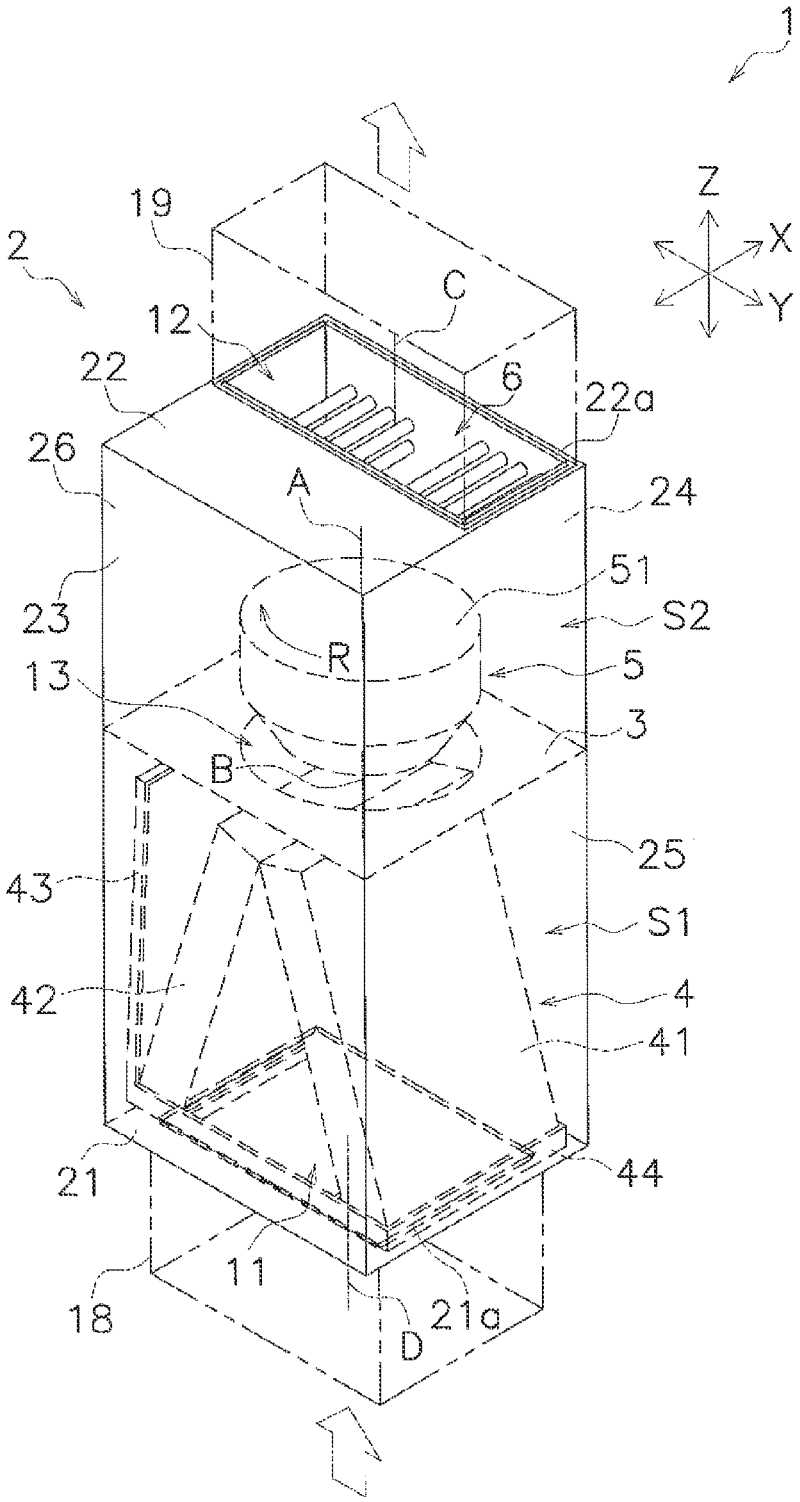
FIG. 1 is an external perspective view of an air conditioning apparatus according to a preferred embodiment of the present invention (in a vertical mount configuration)
Figure 2:
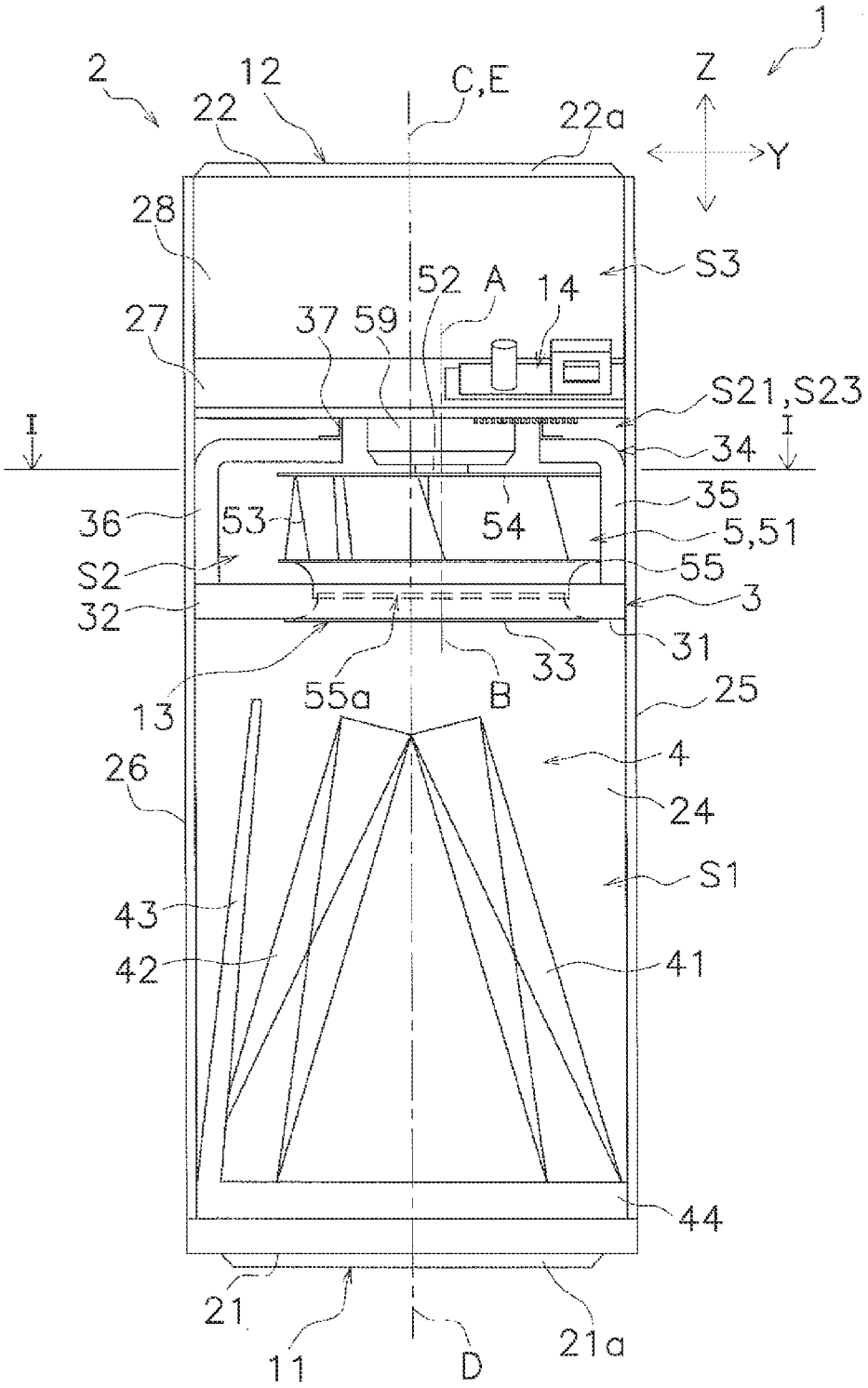
FIG. 2 is a front lateral view of the air conditioning apparatus from which a first lateral part is detached (in the vertical mount configuration)
Figure 3:
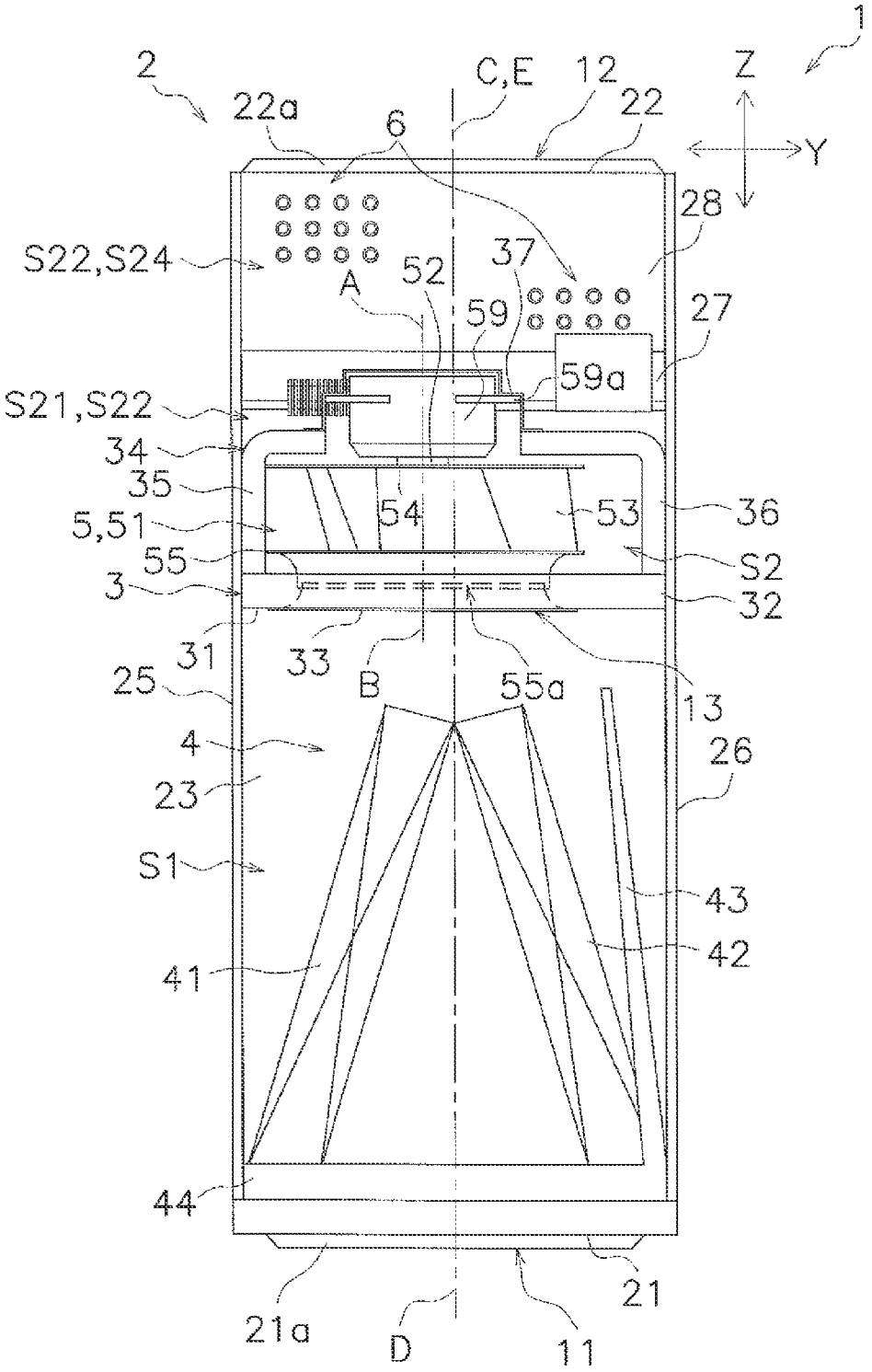
FIG. 3 is a rear lateral view of the air conditioning apparatus from which a second lateral part is detached (in the vertical mount configuration)
Figure 4:
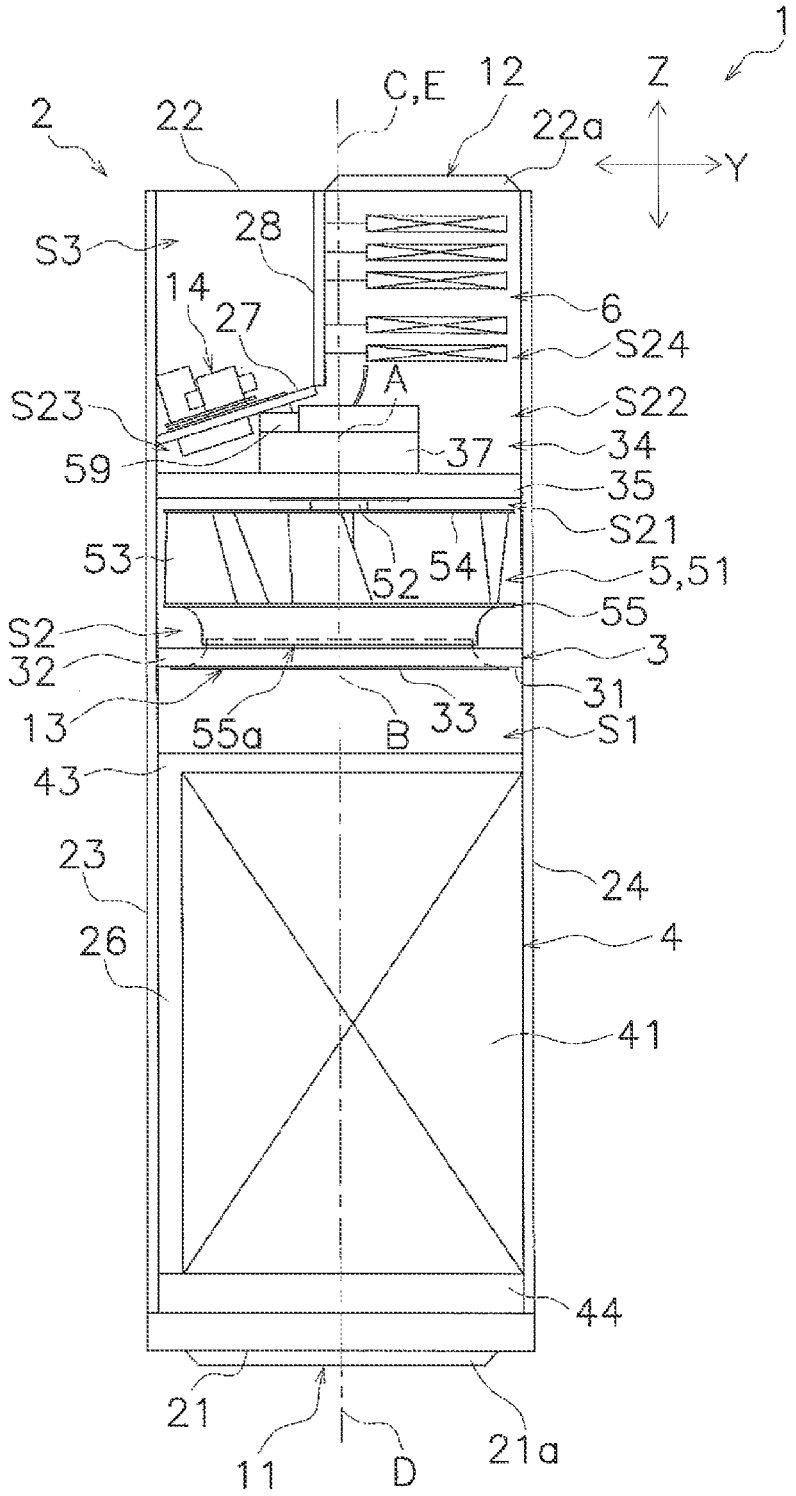
FIG. 4 is a right lateral view of the air conditioning apparatus from which a third lateral part is detached (in the vertical mount configuration)
Figure 5:
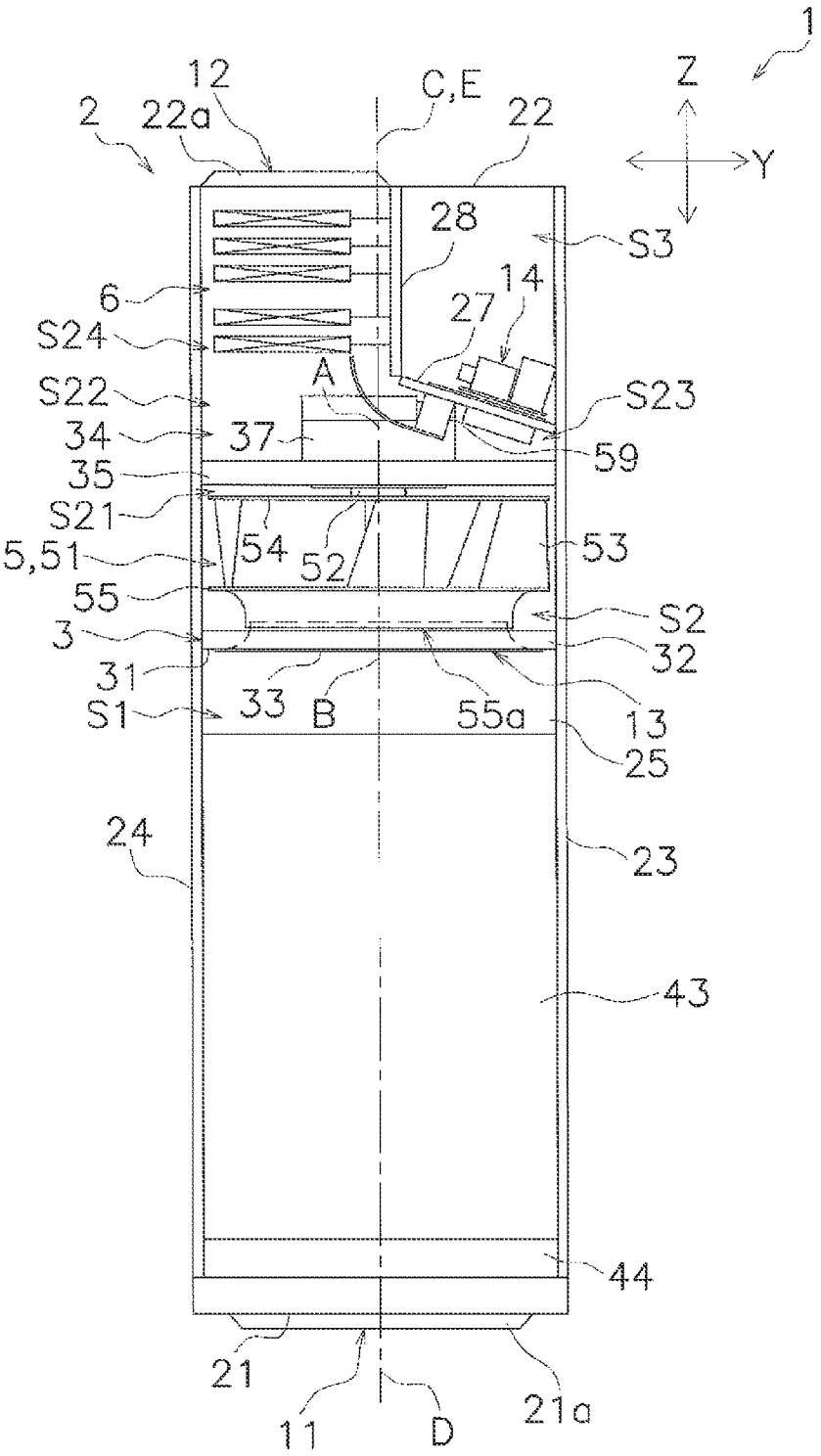
FIG. 5 is a left lateral view of the air conditioning apparatus from which a fourth lateral part is detached (in the vertical mount configuration)
Figure 6:
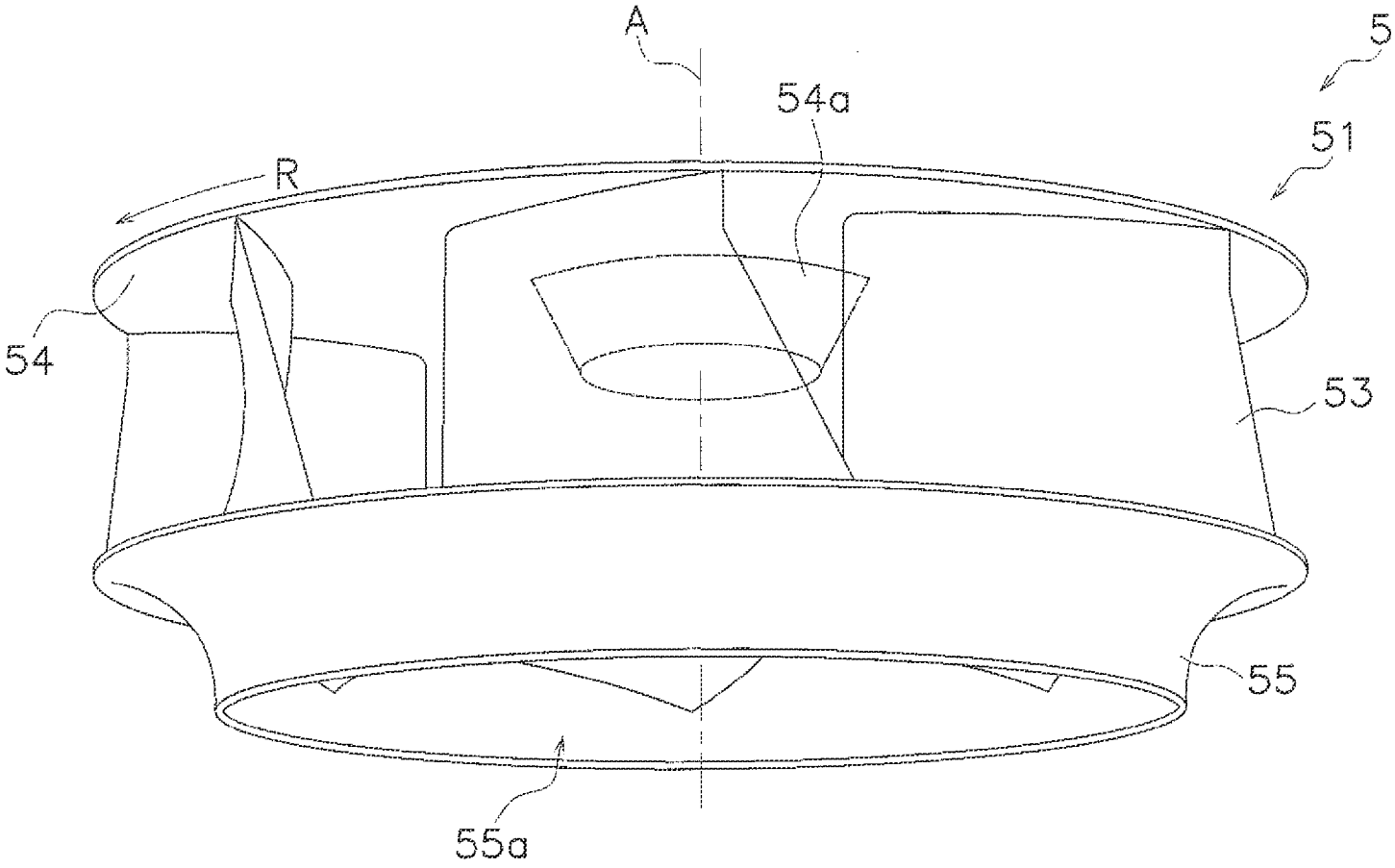
FIG. 6 is an external perspective view of a bladed wheel of a centrifugal fan.
Figure 7:
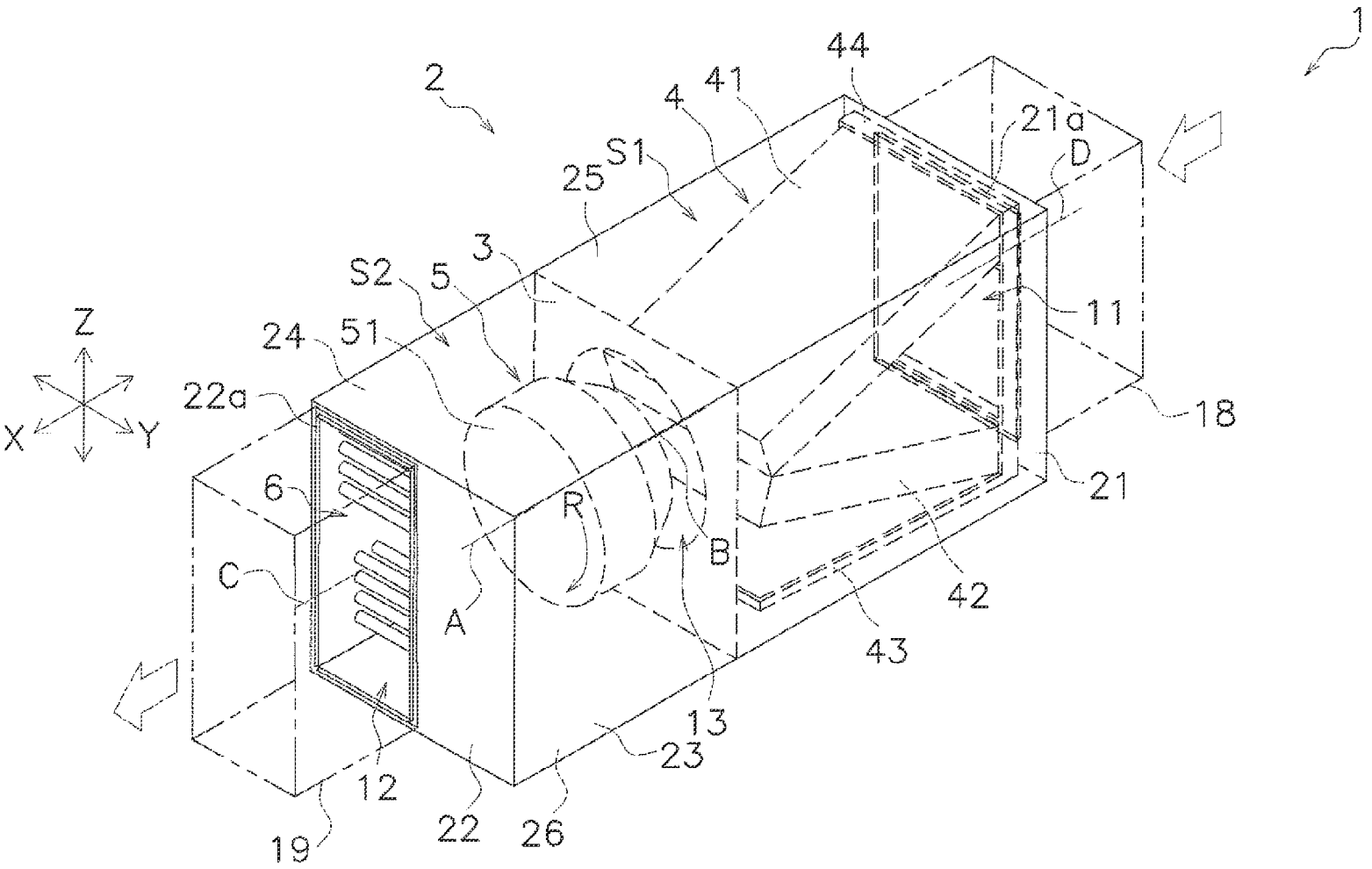
FIG. 7 is an external perspective view of the air conditioning apparatus (in a horizontal mount configuration)
Figure 8:
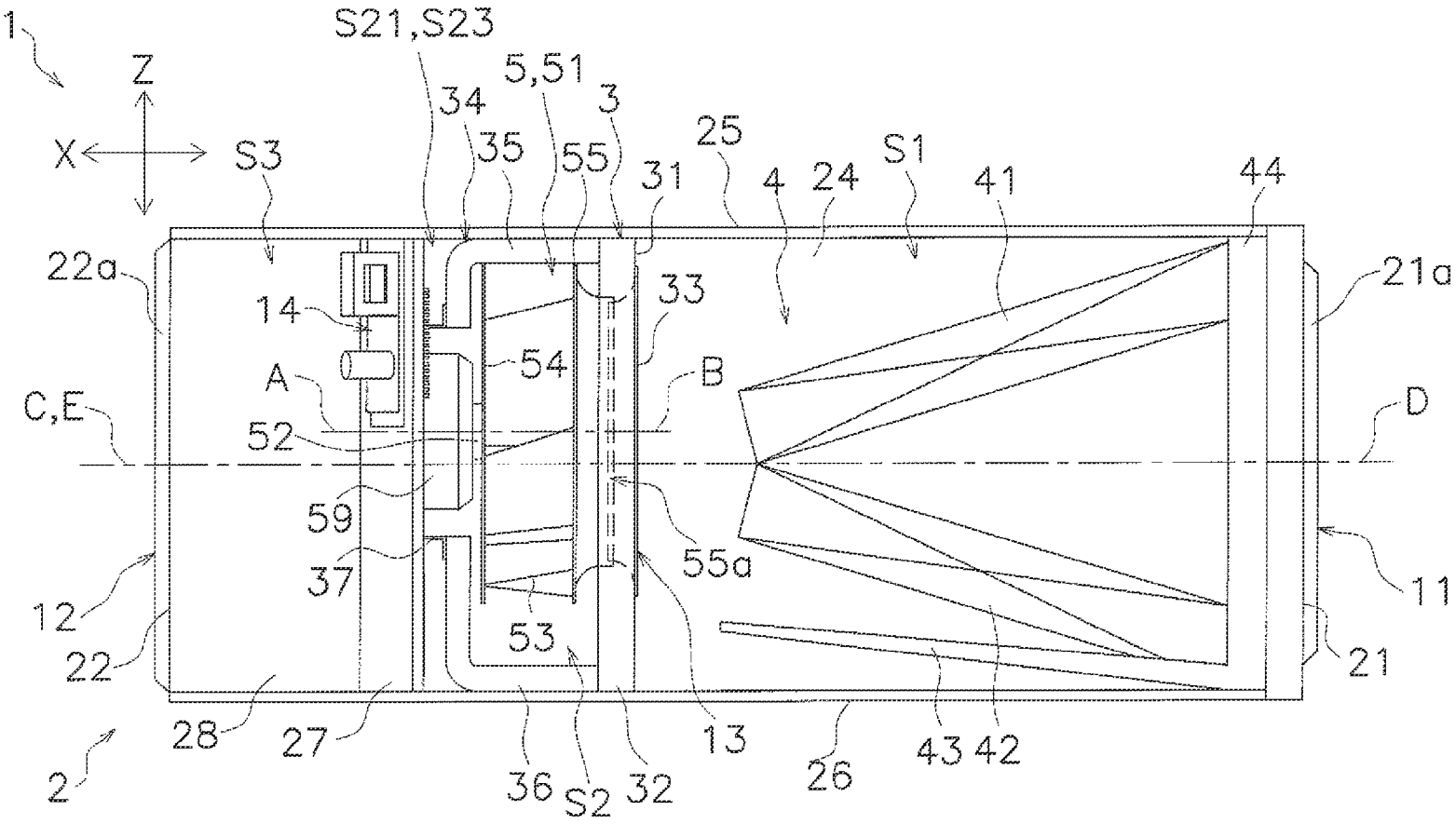
FIG. 8 is a right lateral view of the air conditioning apparatus from which the first lateral part is detached (in the horizontal mount configuration)

First, a basic construction of an air conditioning apparatus 1 will be explained with FIGS. 1 to 8. Here, FIG. 1 is an external perspective view of the air conditioning apparatus 1 according to the preferred embodiment of the present invention (in a vertical mount configuration). FIG. 2 is a front lateral view of the air conditioning apparatus 1 from which a first lateral part 23 is detached (in the vertical mount configuration). FIG. 3 is a rear lateral view of the air conditioning apparatus 1 from which a second lateral part 24 is detached (in the vertical mount configuration). FIG. 4 is a right lateral view of the air conditioning apparatus 1 from which a third lateral part 25 is detached (in the vertical mount configuration). FIG. 5 is a left lateral view of the air conditioning apparatus 1 from which a fourth lateral part 26 is detached (in the vertical mount configuration). FIG. 6 is an external perspective view of a bladed wheel of a centrifugal fan. FIG. 7 is an external perspective view of the air conditioning apparatus 1 (in a horizontal mount configuration). FIG. 8 is a right lateral view of the air conditioning apparatus 1 from which the first lateral part 23 is detached (in the horizontal mount configuration).

The air conditioning apparatus 1 is an apparatus installed in a building in order to perform a cooling operation and a heating operation for the indoor space of the building. The air conditioning apparatus 1 includes a casing 2, a partition member 3, a heat exchanger 4 and a centrifugal fan 5. The casing 2 has an intake port 11 and a blow-out port 12. The partition member 3 divides the interior of the casing 2 into a heat exchanger compartment S1 located on the intake port 11 side and a fan compartment S2 located on the blow-out port 12 side, and has a fan entrance 13 making the heat exchanger compartment S1 and the fan compartment S2 communicate with each other. The heat exchanger 4 is mounted in the heat exchanger compartment S1. The centrifugal fan 5 includes a bladed wheel 51 having a plurality of rearward blades 53 and is configured to suck air existing in the heat exchanger compartment S1 into the fan compartment S2 through the fan entrance 13, with the bladed wheel 51 being mounted in the fan compartment S2 such that a rotary shaft 52 (its axis will be referred to as a rotary axis A) is oriented to an opening direction B of the fan entrance 13.

Moreover, the fan entrance 13 is herein opposed to the blow-out port 12, and the rotary shaft 52 (the rotary axis A) of the bladed wheel 51 is oriented to the opening direction B of the fan entrance 13 and an opening direction C of the blow-out port 12. Furthermore, the intake port 11 is herein opposed to the fan entrance 13, and the rotary shaft 52 (the rotary axis A) of the bladed wheel 51 is oriented to the opening direction B of the fan entrance 13, the opening direction C of the blow-out port 12 and an opening direction D of the intake port 11.

Moreover, the air conditioning apparatus 1 is herein capable of taking two configurations, i.e., the vertical mount configuration and the horizontal mount configuration. In the vertical mount configuration, the casing 2 is disposed such that the rotary shaft 52 (the rotary axis A) of the bladed wheel 51 is oriented to a vertical direction Z (see FIGS. 1 to 5). In the horizontal mount configuration, the casing 2 is disposed such that the rotary shaft 52 (the rotary axis A) of the bladed wheel 51 is oriented to a horizontal direction X (see FIGS. 7 and 8).

As described above, the casing 2 has the intake port 11 and the blow-out port 12. The casing 2 is mainly composed of an upstream lateral part 21, a downstream lateral part 22, the first lateral part 23, the second lateral part 24, the third lateral part 25 and the fourth lateral part 26. These lateral parts 21 to 26 form the elongated cuboid casing 2. The upstream lateral part 21 is a member configured to form the bottom lateral surface of the casing 2 in the vertical mount configuration and form the rear lateral surface of the casing 2 in the horizontal mount configuration. The downstream lateral part 22 is a member configured to form the top lateral surface of the casing 2 in the vertical mount configuration and form the front lateral surface of the casing 2 in the horizontal mount configuration. The upstream lateral part 21 and the downstream lateral part 22 are disposed away from each other in the lengthwise direction of the casing 2 (i.e., a direction along the rotary axis A and the opening directions B, C and D). The upstream lateral part 21 has the intake port 11. The intake port 11 is an opening bored in the middle of the upstream lateral part 21 and is made in the form of a rectangular aperture. The downstream lateral part 22 has the blow-out port 12. The blow-out port 12 is an opening bored in the downstream lateral part 22 so as to be displaced from the middle of the downstream lateral part 22, and is made in the form of a rectangular aperture. The blow-out port 12 is herein located in a position close to the second lateral part 24 within the downstream lateral part 22. The first lateral part 23 is a member configured to form the front lateral surface of the casing 2 in the vertical mount configuration and form the right lateral surface of the casing 2 in the horizontal mount configuration. The second lateral part 24 is a member configured to form the rear lateral surface of the casing 2 in the vertical mount configuration and form the left lateral surface of the casing 2 in the horizontal mount configuration. The first lateral part 23 and the second lateral part 24 are disposed away from each other in a direction orthogonal to the lengthwise direction of the casing 2 (i.e., the horizontal direction X orthogonal to the rotary axis A and the opening directions B, C and D in the vertical mount configuration; a right-and-left direction Y orthogonal to the rotary axis A and the opening directions B, C and D in the horizontal mount configuration). The third lateral part 25 is a member configured to form the right lateral surface of the casing 2 in the vertical mount configuration and form the top lateral surface of the casing 2 in the horizontal mount configuration. The fourth lateral part 26 is a member configured to form the left lateral surface of the casing 2 in the vertical mount configuration and form the bottom lateral surface of the casing 2 in the horizontal mount configuration. The third lateral part 25 and the fourth lateral part 26 are disposed away from each other in a direction orthogonal to the lengthwise direction of the casing 2 (i.e., the right-and-left direction Y orthogonal to the rotary axis A and the opening directions B and C in the vertical mount configuration; the vertical direction Z orthogonal to the rotary axis A and the opening directions B, C and D in the horizontal mount configuration).

Moreover, a plurality of ridges 21*a* are herein formed on the upstream lateral part 21 so as to enclose the circumferential edges of the intake port 11, whereas a plurality of ridges 22*a* are formed on the downstream lateral part 22 so as to enclose the circumferential edges of the blow-out port 12. Furthermore, an intake duct 18 is connected to the intake port 11 through the ridges 21*a*, whereas a blow-out duct 19 is connected to the blow-out port 12 through the ridges 22*a*. With the construction, the air conditioning apparatus 1 is herein configured to be of a duct connection type for sucking and blowing air from and to an air-conditioned room indirectly through the ducts 18 and 19. It should be herein noted that the intake port 11 and the blow-out port 12 are made in forms of rectangular apertures, and likewise, the ducts 18 and 19 are made in forms of rectangular tubes. However, the ports 11 and 12 and the ducts 18 and 19 are not limited to be made in the aforementioned forms, and may employ a variety of forms. Furthermore, the air conditioning apparatus 1 is not limited to be of the duct connection type, and may be of a variety of types such as a type for sucking and blowing air from and to an air-conditioned room directly through the intake port 11 and the blow-out port 12.

As described above, the partition member 3 divides the interior of the casing 2 into the heat exchanger compartment S1 located on the intake port 11 side and the fan compartment S2 located on the blow-out port 12 side, and has the fan entrance 13 that makes the heat exchanger compartment S1 and the fan compartment S2 communicate with each other. The partition member 3 is mainly composed of a partition body 31 made in the form of a rectangular plate. The partition body 31 is disposed in parallel to a direction orthogonal to the lengthwise direction of the casing 2 (i.e., a direction orthogonal to the rotary axis A and the opening directions B, C and D). The fan entrance 13 is bored in the partition body 31 and is herein made in the form of a circular aperture. The partition body 31 has a partition circumferential part 32 made in the form of a rectangular frame. The partition circumferential part 32 extends from the circumferential edges of the partition body 31 toward the fan compartment S2 along the inner surfaces of the lateral parts 23 to 26 of the casing 2.

As described above, the heat exchanger 4 is mounted in the heat exchanger compartment S1. In a cooling operation, the heat exchanger 4 is configured to cool air flowing through the heat exchanger compartment S1 by a refrigerant. Contrarily in a heating operation, the heat exchanger 4 is also capable of heating air flowing through the heat exchanger compartment S1 by the refrigerant. A fin tube heat exchanger, composed of multiple fins and a heat transfer tube, is herein employed as the heat exchanger 4. Furthermore, the refrigerant is configured to be supplied to the heat exchanger 4 from an outdoor unit installed outside the building or so forth. The heat exchanger 4 is composed of a part 41 located closely to the third lateral part 25 of the casing 2 and a part 42 located closely to the fourth lateral part 26 of the casing 2. Moreover, the part 41 of the heat exchanger 4, located closely to the third lateral part 25, is disposed in a tilt position so as to get closer to the third lateral part 25 from a side near to the fan entrance 13 to a side near to the intake port 11. The part 42 of the heat exchanger 4, located closely to the fourth lateral part 26, is disposed in a tilt position so as to get closer to the fourth lateral part 26 from the side near to the fan entrance 13 to the side near to the intake port 11. With the construction, the heat exchanger 4 has a V shape so as to get closer to the third lateral part 25 and the fourth lateral part 26 of the casing 2 from the side near to the fan entrance 13 to the side near to the intake port 11. It should be noted that the heat exchanger 4 is not limited to have the V shape, and may employ a variety of shapes.

Moreover, drain pans 43 and 44 are mounted in the heat exchanger compartment S1 in order to receive water produced by dew condensation in the heat exchanger 4. The first drain pan 43 is configured to be used when the casing 2 is disposed such that the rotary shaft 52 (the rotary axis A) of the bladed wheel 51 is oriented to the horizontal direction X (in the horizontal mount configuration). The second drain pan 44 is configured to be used when the casing 2 is disposed such that the rotary shaft 52 (the rotary axis A) of the bladed wheel 51 is oriented to the vertical direction Z (in the vertical mount configuration). The first drain pan 43 is disposed in a position close to the fourth lateral part 26, which is one of the lateral parts 23 to 26 of the casing 2 that are disposed along the opening direction B of the fan entrance 13. With the construction, the first drain pan 43 is configured to be disposed over the fourth lateral part 26 forming the bottom lateral surface of the casing 2 and receive the bottom side of the heat exchanger 4 in the horizontal mount configuration. The second drain pan 44 is disposed in a position close to the upstream lateral part 21, which is one of the lateral parts 21 and 22 of the casing 2 that are disposed along the direction orthogonal to the opening direction B of the fan entrance 13. With the construction, the second drain pan 44 is configured to be disposed over the upstream lateral part 21 forming the bottom lateral surface of the casing 2 and receive the bottom side of the heat exchanger 4 in the vertical mount configuration. Furthermore, the first and second drain pans 43 and 44 are herein compatible with the vertical mount configuration and the horizontal mount configuration, but the first drain pan 43 to be used in the horizontal mount configuration exists in the heat exchanger compartment S1 even in the vertical mount configuration, whereas the second drain pan 44 to be used in the vertical mount configuration exists in the heat exchanger compartment S1 even in the horizontal mount configuration.

As described above, the centrifugal fan 5 includes the bladed wheel 51 having the plural rearward blades 53 and is configured to suck air existing in the heat exchanger compartment S1 into the fan compartment S2 through the fan entrance 13, with the bladed wheel 51 being mounted in the fan compartment S2 such that the rotary shaft 52 (the rotary axis A) is oriented to the opening direction B of the fan entrance 13. Furthermore, a fan motor 59 is mounted in the fan compartment S2 in order to drive and rotate the bladed wheel 51. Here in the fan compartment 2, the bladed wheel 51 is disposed proximally to the fan entrance 13 and the fan motor 59 is disposed on the downwind side of the bladed wheel 51 along the rotary shaft 52 (the rotary axis A) of the bladed wheel 51. Moreover, a bell mouth 33 is mounted to the fan entrance 13. A space, located on the downwind side of the bladed wheel 51 in the fan compartment S2, is herein defined as a fan downwind space S21. Thus, the fan motor 59 is disposed in the fan downwind space S21.

The bladed wheel 51 is composed of a hub 54, a shroud 55 and the plural rearward blades 53 disposed between the hub 54 and the shroud 55. The hub 54 connects the blow-out port 12 side ends of the plural rearward blades 53, and is configured to be rotated about the rotary shaft 52 (the rotary axis A). The hub 54 is a disc-shaped member and has a hub protrusion 54*a* protruding from its middle toward the shroud 55. The hub protrusion 54*a* is coupled to the fan motor 59. The shroud 55 is disposed on the fan entrance 13 side of the hub 54 so as to be opposed to the hub 54, connects the fan entrance 13 side ends of the plural rearward blades 53, and is configured to be rotated about the rotary shaft 52 (the rotary axis A). The shroud 55 is an annular member and has a fan opening 55*a* that is bored in the form of a circular aperture and is centered at the rotary shaft 52 (the rotary axis A). The shroud 55 has a curved shape that its outer diameter increases toward a side near to the hub 54. The plural rearward blades 53 are disposed between the hub 54 and the shroud 55 so as to be aligned at predetermined intervals along the circumferential direction of the rotary shaft 52 (the rotary axis A). Each rearward blade 53 tilts oppositely to a rotary direction R of the bladed wheel 51 (herein a clockwise direction in a view seen from the blow-out port 12 side) with respect to the radial direction of the hub 54.

The bell mouth 33 is mounted to the fan entrance 13 of the partition member 3 so as to be opposed to the fan opening 55*a* of the bladed wheel 51 and directs air, flowing thereto from the heat exchanger compartment S1, to the fan opening 55*a* of the bladed wheel 51. The bell mouth 33 is an annular member centered at the rotary shaft 52 (the rotary axis A). The bell mouth 33 has a curved shape that its outer diameter decreases toward a side near to the shroud 55.

The fan motor 59 is disposed concentrically to the rotary shaft 52 (the rotary axis A) of the bladed wheel 51 in the fan downwind space S21. The fan motor 59 has a columnar shape centered at the rotary shaft 52 (the rotary axis A). The fan motor 59 is herein fixed to the partition member 3 through a motor support base 34. Specifically, the motor support base 34 is composed of support frames 35 and 36 forming a roughly squared U shape. The support frames 35 and 36 respectively extend toward the vicinity of the outer peripheral surface of the fan motor 59 from parts of the partition circumferential part 32 of the partition member 3, i.e., a part located closely to the third lateral part 25 of the casing 2 and a part located closely to the fourth lateral part 26 of the casing 2. Moreover, the fan motor 59 is fixed at its end plate parts 59*a* to the support frames 35 and 36 through a bracket 37. The end plate parts 59*a* extend from the outer peripheral surface of the fan motor 59 toward the third lateral part 25 and the fourth lateral part 26. Thus, the centrifugal fan 5, including the bladed wheel 51 and the fan motor 59, is designed to be fixed to the partition member 3 through the motor support base 34. With the construction, the entirely of the centrifugal fan 5 is configured to be detachable by detaching the partition member 3 from the casing 2 in performing a maintenance work or so forth.

Moreover, the fan downwind space S21 of the fan compartment S2 has a blow-out port opposed space S22 as a region opposed to the blow-out port 12. The blow-out port 12 is herein disposed in the position close to the second lateral part 24 within the downstream lateral part 22. Thus, when the casing 2 is seen from the blow-out port 12 side, the blow-out port opposed space S22 is formed by a space enclosed by parts located along the circumferential edges of the opening of the blow-out port 12, i.e., the second lateral part 24, a part of the third lateral part 25 that is located closely to the second lateral part 24, and a part of the fourth lateral part 26 that is located closely to the second lateral part 24. Furthermore, a blow-out port non-opposed surface part 27 is mounted in a position on the downwind side of the bladed wheel 51 so as to be opposed to the fan entrance 13, and accordingly, a blow-out port non-opposed space S23 is formed as a space excluding the blow-out port opposed space S22 within the fan downwind space S21 so as not to be opposed to the blow-out port 12 but to be opposed to the blow-out port non-opposed surface part 27. Moreover, a blow-out port circumferential surface part 28 is herein provided so as to extend from the blow-out port 12 side end of the blow-out port non-opposed surface part 27 toward the blow-out port 12 along the opening direction B of the fan entrance 13 and the opening direction C of the blow-out port 12. With the construction, an electric component compartment S3 is herein formed by the blow-out port non-opposed surface part 27, the blow-out port circumferential surface part 28, the first lateral part 23, the third lateral part 25, the fourth lateral part 26, and a part of the downstream lateral part 22 that is located closely to the first lateral part 23 and in which the blow-out port 12 is not formed. The electric component compartment S3 accommodates electric components 14 to be used for controlling devices that make up the air conditioning apparatus 1. Furthermore, a blow-out pathway region S24, having the same opening size as the blow-out port 12, is formed by a region located closely to the blow-out port 12 within the blow-out port opposed space S22, i.e., a space enclosed by the blow-out port circumferential surface part 28, the second lateral part 24, a part of the third lateral part 25 that is located closely to the second lateral part 24, and a part of the fourth lateral part 26 that is located closely to the second lateral part 24.

Moreover, an electric heater 6 is herein mounted in the fan downwind space S21 of the fan compartment S2 in order to heat air blown out to the fan downwind space S21 by the bladed wheel 51 of the centrifugal fan 5. The electric heater 6 is heating means for heating air flowing through the fan compartment S2 in a heating operation. A heating element assembly with coiled electric heating wires is herein employed as the electric heater 6 (heating means). The electric heater 6 (the heating means) is disposed in the blow-out port opposed space S22, i.e., a region opposed to the blow-out port 12 within the fan downwind space S21. More specifically, the electric heater 6 (the heating means) is disposed in the blow-out pathway region S24 close to the blow-out port 12 within the blow-out port opposed space S22. It should be noted that the electric heater 6 (the heating means) is not limited to the heating element assembly with the coiled electric heating wires, and alternatively, may employ a variety of types of heater.

(2) Basic Action of Air Conditioning Apparatus

Next, a basic action of the air conditioning apparatus 1 will be explained with FIGS. 1 to 8.

In the air conditioning apparatus 1 having the aforementioned construction, the bladed wheel 51 of the centrifugal fan 5 is configured to be rotated by driving of the fan motor 59. This produces the flow of air passing through the interior of the casing 2 sequentially in the order of the intake port 11, the heat exchanger compartment S1, the fan entrance 13, the fan compartment S2 and the blow-out port 12.

Now in the cooling operation, air fed to the interior of the casing 2 through the intake port 11 flows into the heat exchanger compartment S1, and is cooled by the refrigerant flowing through the heat exchanger 4. Then, the air cooled by the heat exchanger 4 flows into the fan compartment S2 through the fan entrance 13 and is sucked into the bladed wheel 51 of the centrifugal fan 5. The air sucked into the bladed wheel 51 is blown out to the fan downwind space S21 located on the downwind side of the bladed wheel 51. The air blown out to the fan downwind space S21 is fed to the outside of the casing 2 through the blow-out port 12.

On the other hand, in the heating operation, air fed to the interior of the casing 2 through the intake port 11 flows into the heat exchanger compartment S1, and is heated by the refrigerant flowing through the heat exchanger 4. The air heated by the heat exchanger 4 flows into the fan compartment S2 through the fan entrance 13, and is sucked into the bladed wheel 51 of the centrifugal fan 5. The air sucked into the bladed wheel 51 is blown out to the fan downwind space S21 located on the downwind side of the bladed wheel 51. The air blown out to the fan downwind space S21 is further heated by the electric heater 6 (the heating means), and is then fed to the outside of the casing 2 through the blow-out port 12.

(3) Construction for Enhancing Ventilation Performance of Centrifugal Fan

In the air conditioning apparatus 1 having the aforementioned construction, the centrifugal fan 5 having the rearward blades 53 is mounted in the fan compartment S2 having the fan entrance 13 bored in opposition to the blow-out port 12 such that the rotary shaft 52 (the rotary axis A) is oriented to the opening direction B of the fan entrance 13 and the opening direction C of the blow-out port 12.

Figure 9:
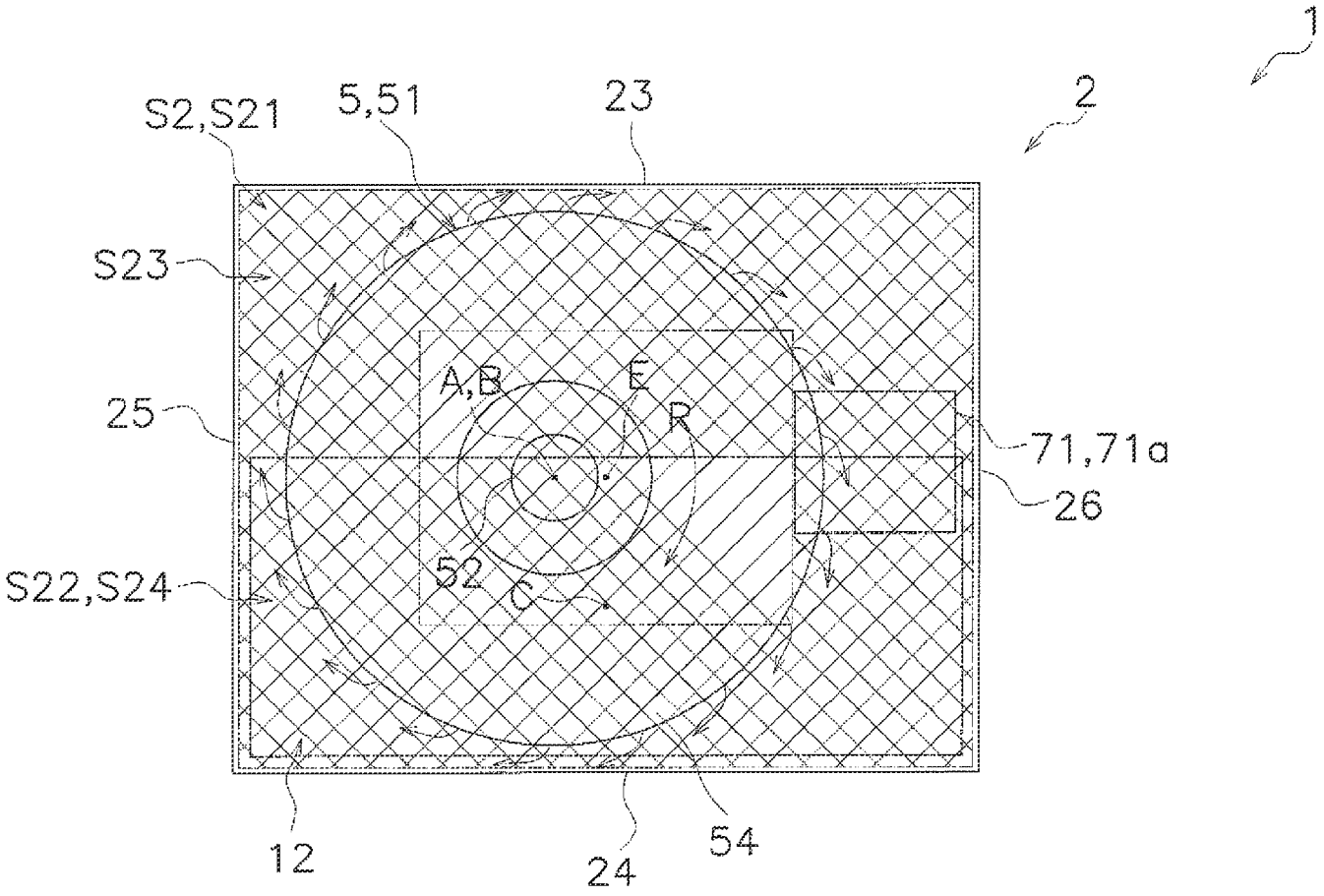
FIG. 9 is a cross-sectional view of FIG. 2 taken along line I-I.

Air blown out by the bladed wheel 51 of the centrifugal fan 5 herein tends to swirl in the rotary direction R of the bladed wheel 51 and simultaneously flow along the lateral parts 23 to 26 of the casing 2 when the casing 2 is seen from a direction along the rotary shaft 52 (the rotary axis A) of the centrifugal fan 5 (i.e., the opening direction B of the fan entrance 13 and the opening direction C of the blow-out port 12) (see FIG. 9). FIG. 9 is herein a cross-sectional view of FIG. 2 taken along line I-I. Additionally in FIG. 9, arrows indicate the flow of air blown out from the bladed wheel 51, whereas cross hatching indicates regions in which air flows at a high speed.

Therefore, the air conditioning apparatus 1 is demanded to enhance the ventilation performance of the centrifugal fan 5 in consideration of the aforementioned flow tendency of air from the centrifugal fan 5.

Figure 10:
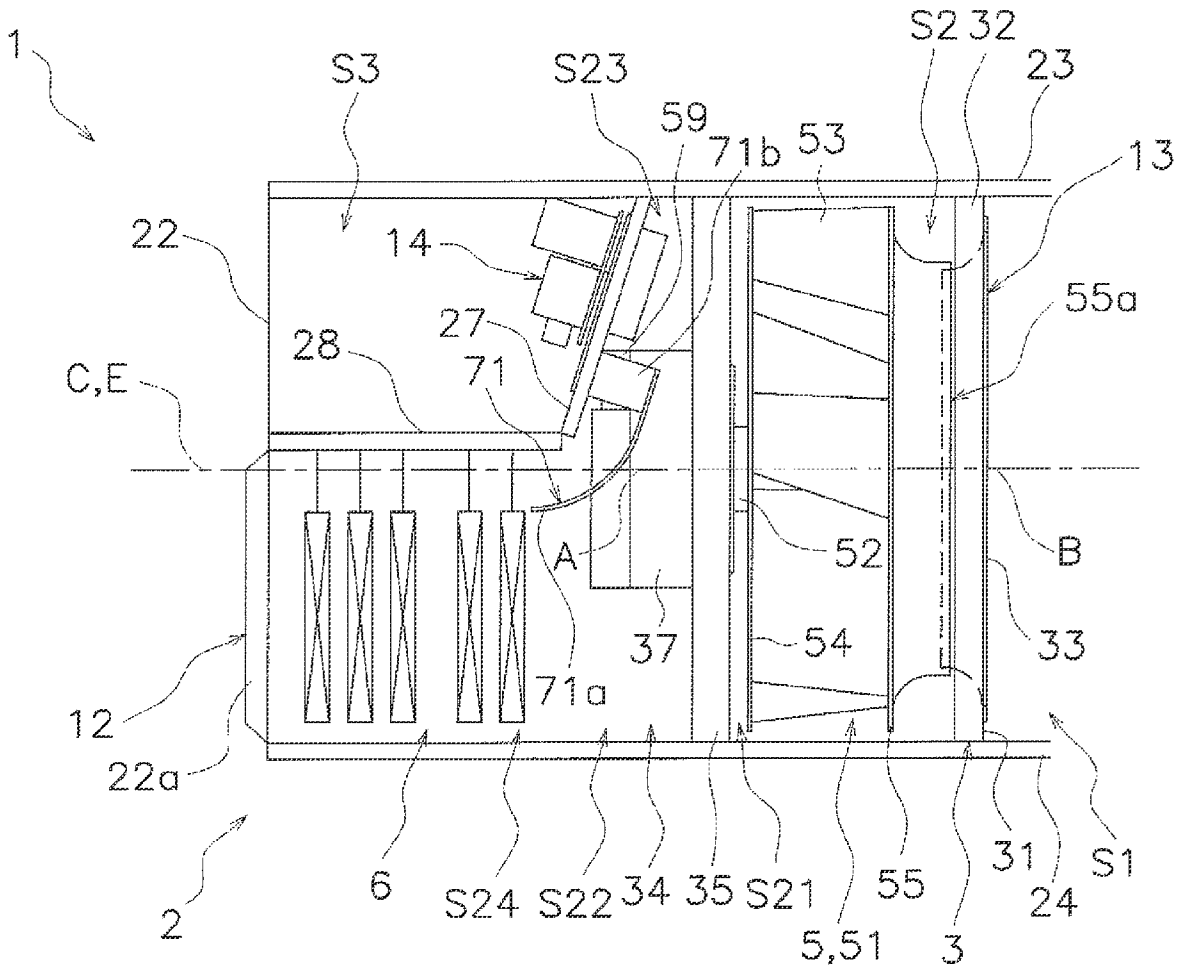
FIG. 10 is an enlarged view of a fan compartment and its vicinity in FIG. 5.

In view of the above, the blow-out port and the fan downwind space are herein contrived in their positional arrangements. Specifically, a part of the blow-out port 12 (a right part of the blow-out port 12 in FIG. 9) is disposed in a position close to the fourth lateral part 26 (a blow-out port nearby lateral part), which is one of the lateral parts of the casing 2 that are disposed along the direction of the rotary shaft 52 (the rotary axis A) (i.e., the opening direction B of the fan entrance 13 and the opening direction C of the blow-out port 12) (see FIGS. 1, 4, 5, 7 and 9). Put differently, the blow-out port 12 is herein disposed in the downstream lateral part 22 so as to be displaced closely to the second lateral part 24, and accordingly, a part of the blow-out port 12 (i.e., the right part of the blow-out port 12 in FIG. 9) is disposed in a position close to the fourth lateral part 26 (the blow-out port nearby lateral part). Additionally, in order to direct air existing in the blow-out port non-opposed space S23 to flow toward the blow-out port opposed space S22, a first guide member 71 is mounted in a boundary region located astride a region located on a forward side in the rotary direction R within the blow-out port non-opposed space S23 and a region located on a rearward side in the rotary direction R of the bladed wheel 51 within the blow-out port opposed space S22 (see FIGS. 9 and 10). As described above, the boundary region, located astride the region located on the forward side in the rotary direction R of the bladed wheel 51 within the blow-out port non-opposed space S23 and the region located on the rearward side in the rotary direction R of the bladed wheel 51 within the blow-out port opposed space S22, is herein formed in a position close to the fourth lateral part 26. Thus, the first guide member 71 is disposed in a position close to the fourth lateral part 26. FIG. 10 is herein an enlarged view of the fan compartment S2 and its vicinity in FIG. 5.

Figure 11:
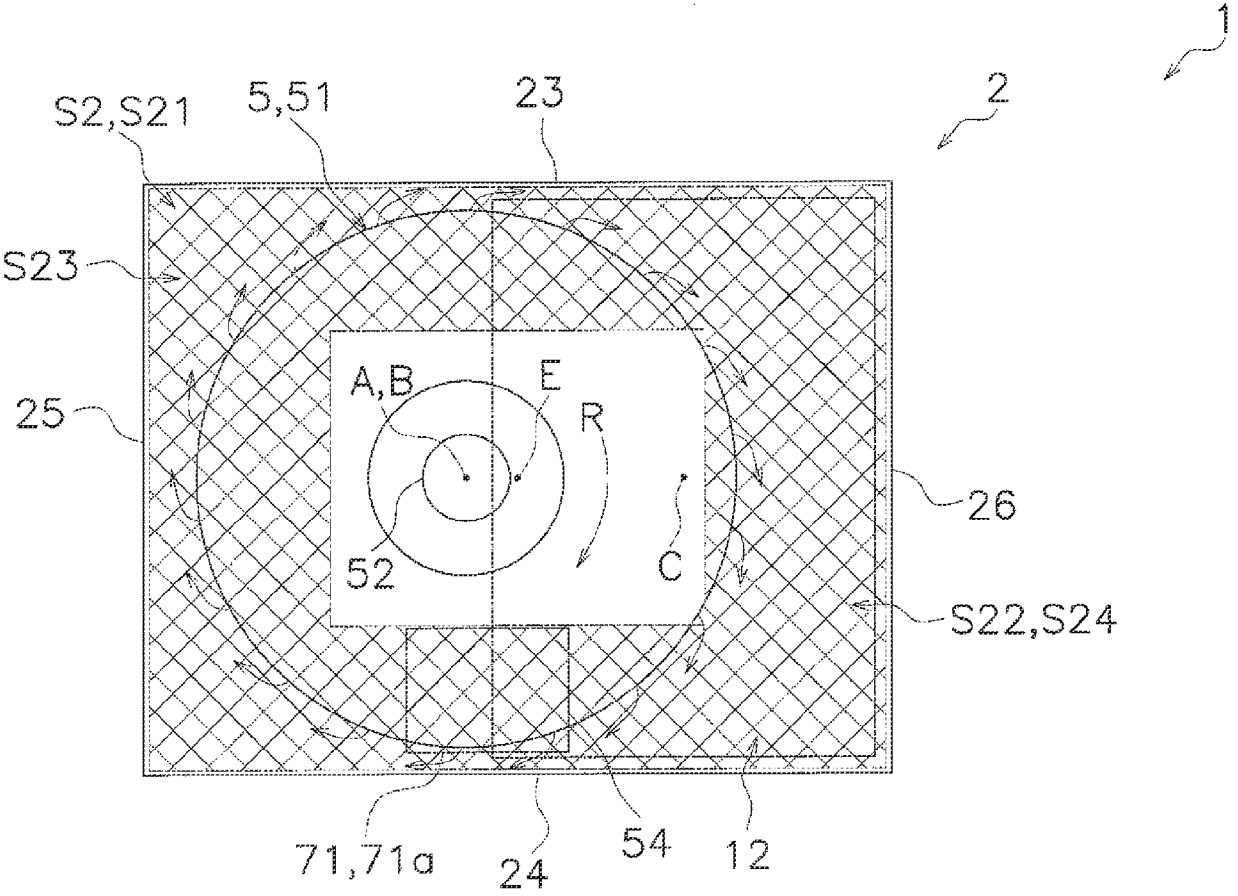
FIG. 11 is a diagram corresponding to FIG. 9 and shows a construction that a blow-out port is entirely located closely to a blow-out port nearby lateral part.

It should be herein noted that a part of the blow-out port 12 is disposed in a position close to the fourth lateral part 26. However, the positional arrangement of the blow-out port 12 is not limited to the above. For example, a part of the blow-out port 12 may be disposed in a position close to another lateral part of the casing 2 such as the third lateral part 25. Furthermore, a part of the blow-out port 12 (the right part of the blow-out port 12 in FIG. 9) is herein disposed in a position close to the fourth lateral part 26. However, the positional arrangement of the blow-out port 12 is not limited to the above. For example, as shown in FIG. 11, the entirety of the blow-out port 12 may be disposed in a position close to the fourth lateral part 26 (the blow-out port nearby lateral part) opposed to the third lateral part 25 (the bladed wheel nearby lateral part). Put differently, the blow-out port 12 is only required to be at least partially disposed in a position close to the fourth lateral part 26 (the blow-out port nearby lateral part), which is one of the lateral parts 23 to 26 of the casing 2 that are disposed along the direction of the rotary shaft 52 (the rotary axis A) (i.e., the opening direction B of the fan entrance 13 and the opening direction C of the blow-out port 12).

Thus, at least a part of the blow-out port 12 is herein designed to be disposed closely to the blow-out port nearby lateral part, and the first guide member 71 is designed to be mounted in the boundary region located astride the region located on the forward side in the rotary direction R of the bladed wheel 51 within the blow-out port non-opposed space S23 and the region located on the rearward side in the rotary direction R of the bladed wheel 51 within the blow-out port opposed space S22. With the construction, ventilation resistance can be herein reduced in the fan compartment S2 by promoting the swirling flow of air blown out by the bladed wheel 51 of the centrifugal fan 5.

Consequently, the ventilation performance of the centrifugal fan 5 can be herein more enhanced than a well-known construction for directing air blown out by the bladed wheel 51 of the centrifugal fan 5 to flow closely to the middle of the casing 2.

Additionally, the first guide member 71 herein has a first guide body 71*a* that is formed along the shape of the blow-out port non-opposed surface part 27 and is disposed away from the blow-out port non-opposed surface part 27 at an interval (see FIG. 10). The blow-out port non-opposed surface part 27 herein has a slant shape so as to be gradually away from the bladed wheel 51 in a direction from a side near to the fan entrance 13 to a side near to the blow-out port 12. Hence, the first guide body 71*a* also slants along the slant shape of the blow-out port non-opposed surface part 27. Furthermore, the first guide body 71*a* is fixed to the blow-out port non-opposed surface part 27 through a first guide support part 71*b*. The first guide support part 71*b* extends from the first guide body 71*a* toward the blow-out port non-opposed surface part 27.

As described above, the first guide body 71*a* of the first guide member 71 is herein formed along the shape of the blow-out port non-opposed surface part 27, and is disposed away from the blow-out port non-opposed surface part 27 at an interval. With the construction, air existing in the blow-out port non-opposed space S23 is herein configured to be directed toward the blow-out port opposed space S22 through a region between the first guide member 71 and the blow-out port non-opposed surface part 27.

Consequently, air existing in the blow-out port non-opposed space S23 can be herein smoothly directed toward the blow-out port opposed space S22.

Moreover, when seen from the direction orthogonal to the rotary shaft 52 (the rotary axis A), the first guide body 71*a* gradually curves toward the blow-out port 12 from the blow-out port non-opposed space S23 side to the blow-out port opposed space S22 side (see FIG. 10).

As described above, the first guide body 71*a* of the first guide member 71 herein curves toward the blow-out port 12 when seen from the direction orthogonal to the rotary shaft 52 (the rotary axis A). With the construction, air existing in the blow-out port non-opposed space S23 is herein directed toward the blow-out port opposed space S22 and is easily directed toward the blow-out port 12.

Consequently, air existing in the blow-out port non-opposed space S23 can be herein easily directed to the blow-out port 12 through the blow-out port opposed space S22. In particular, the blow-out port 12 side end of the first guide body 71*a* herein reaches the blow-out pathway region S24 of the blow-out port opposed space S22. This enhances the effect of easily directing air to the blow-out port 12.

Moreover, when seen from the direction along the rotary shaft 52 (the rotary axis A), the first guide member 71 is herein disposed so as to overlap with the bladed wheel 51 (see FIGS. 9 and 11). More specifically, when the first guide member 71 is seen from the blow-out port 12 side, an end of the first guide member 71, located closely to the rotary shaft 52 (the rotary axis A), is disposed in a position along a direction transverse to the hub 54 of the bladed wheel 51.

With the construction, a part of the first guide member 71, located closely to the rotary shaft 52 (the rotary axis A), overlaps with the bladed wheel 51.

Thus, when seen from the direction along the rotary shaft 52 (the rotary axis A), the first guide member 71 is herein designed to be disposed so as to overlap with the bladed wheel 51. With the construction, it is possible to reliably trap and promote the swirling airflow in regions that air flows at a high speed while swirling as shown in FIGS. 9 and 11. Therefore, air existing in the blow-out port non-opposed space S23 can be herein reliably directed toward the blow-out port opposed space S22.

Consequently, the ventilation performance of the centrifugal fan 5 can be herein reliably enhanced.

Figure 12:
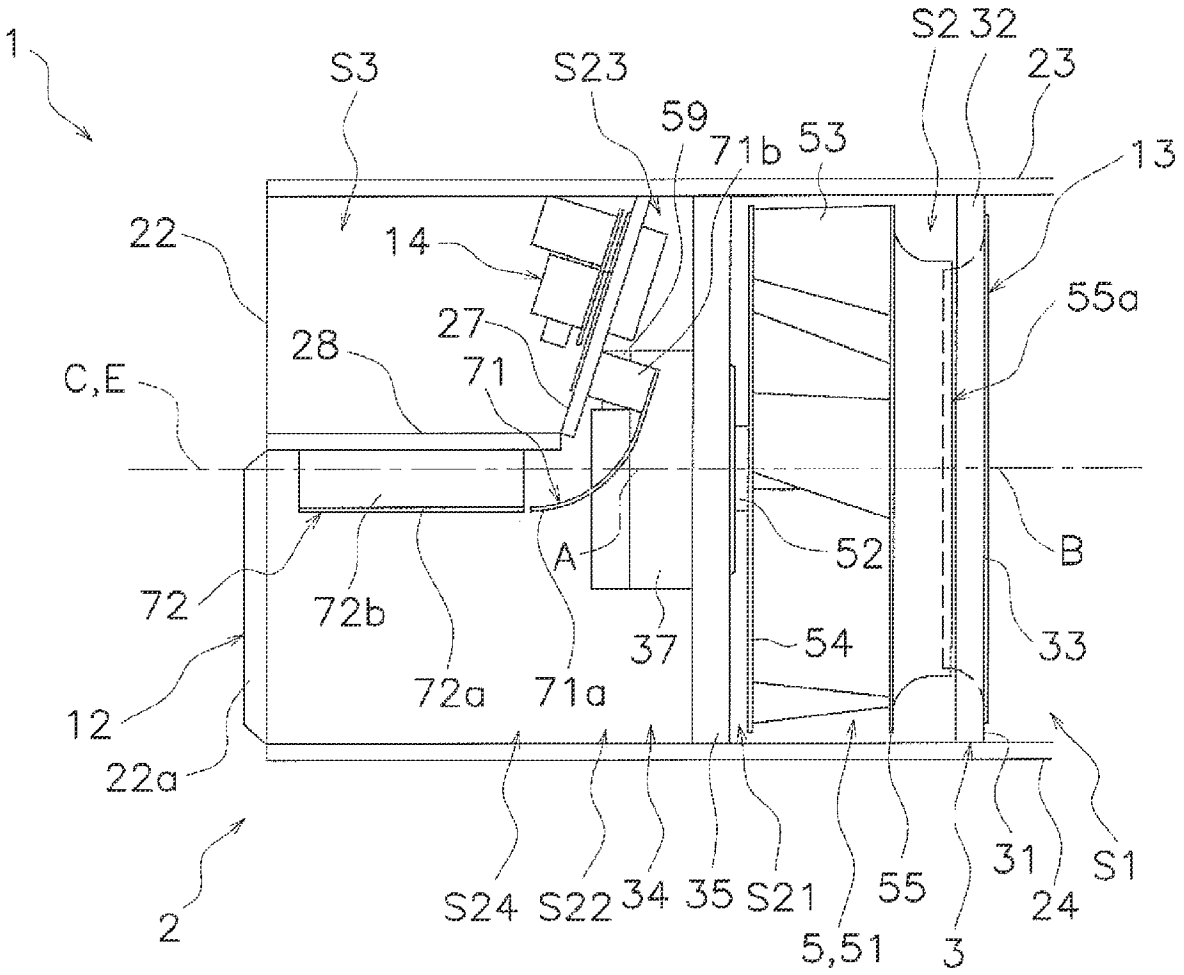
FIG. 12 is a diagram corresponding to FIG. 10 and shows a construction obtained by addition of a second guide member.

(4) Configuration for Further Enhancing Ventilation Performance of Centrifugal Fan As shown in FIG. 12, the aforementioned configuration having the first guide member 71 may be additionally provided with a second guide member 72 in order to further enhance the ventilation performance of the centrifugal fan 5. Specifically, the second guide member 72 is mounted in the blow-out port opposed space S22, such that after directed to the blow-out port opposed space S22, air can be further directed toward the blow-out port 12. FIG. 12 is herein a diagram showing a construction obtained by addition of the second guide member 72, and corresponds to FIG. 10 (note the electric heater 6 is not herein illustrated).

Thus, the second guide member 72 is herein designed to be provided as well as the first guide member 71. With the construction, after directed to the blow-out port opposed space S22 by the first guide member 71, air can be herein further directed toward the blow-out port 12 by the second guide member 72.

Consequently, air can be herein smoothly directed to the blow-out port 12 after directed to the blow-out port opposed space S22.

Additionally, the second guide member 72 herein has a second guide body 72*a*. The second guide body 72*a* extends toward the blow-out port 12 so as to continue from the blow-out port 12 side end of the first guide member 71 (see FIG. 12). The second guide body 72*a* is herein formed in parallel to the blow-out port circumferential surface part 28 and is disposed away from the blow-out port circumferential surface part 28 at an interval. Furthermore, the second guide body 72*a* is fixed to the blow-out port circumferential surface part 28 through a second guide support part 72*b*. The second guide support part 72*b* extends from the second guide body 72*a* toward the blow-out port circumferential surface part 28.

Thus, the second guide body 72*a* of the second guide member 72 is herein designed to extend toward the blow-out port 12 so as to continue from the blow-out port 12 side end of the first guide member 71. With the construction, air is herein easily directed toward the blow-out port 12 through the second guide member 72 after directed to the blow-out port opposed space S22 by the first guide member 71.

Consequently, air existing in the blow-out port non-opposed space S23 can be herein easily directed to the blow-out port 12 through the blow-out port opposed space S22.

The invention claimed is:

1. An air conditioning apparatus, comprising:

a casing having an intake port and a blow-out port;

a partition member dividing an interior of the casing into a heat exchanger compartment located on an intake port side and a fan compartment located on a blow-out port side, the partition member having a fan entrance, the fan entrance being bored in opposition to the blow-out port and making the heat exchanger compartment and the fan compartment communicate with each other;

a heat exchanger mounted in the heat exchanger compartment;

a centrifugal fan including a bladed wheel having a plurality of rearward blades and being configured to suck air existing in the heat exchanger compartment into the fan compartment through the fan entrance, with the bladed wheel being mounted in the fan compartment such that a rotary shaft of the bladed wheel is oriented along a first axial direction direction perpendicular to a second lateral direction along which the partition member extends; and a first guide member, the blow-out port being at least partially disposed in a position adjacent to a blow-out port nearby lateral part, the blow-out port nearby lateral part being one of multiple lateral parts of the casing that are disposed along the first axial direction, the fan compartment including a fan downwind space, the fan downwind space being a space located on a downwind side of the bladed wheel within the fan compartment and having a blow-out port opposed space and a blow-out port non-opposed space, the blow-out port opposed space being a region upstream of and aligned with the blow-out port within the fan downwind space, the blow-out port non-opposed space being a region laterally offset from the blow-out port opposed space and axially on a fan side of a blow-out port non-opposed surface part within the fan downwind space, the blow-out port non-opposed surface part being opposed to the fan entrance in a position located on the downwind side of the bladed wheel and being laterally offset from the blow-out port opposed space and extending partially across the fan downwind space, and the first guide member being arranged and configured to direct air existing in the blow-out port non-opposed space toward the blow-out port opposed space, the first guide member extending from within the blow-out port non-opposed space to a region within the blow-out port opposed space.

2. The air conditioning apparatus according to claim 1, wherein the first guide member has a first guide body, and the first guide body is formed along a shape of the blow-out port non-opposed surface part and is disposed away from the blow-out port non-opposed surface part at an interval.

3. The air conditioning apparatus according to claim 2, wherein the first guide body gradually curves toward the blow-out port as the first guide body extends from the blow-out port non-opposed space to the blow-out port opposed space as viewed orthogonally relative to the first axial direction.

4. The air conditioning apparatus according to claim 1, wherein the first guide member is disposed so as to overlap with the bladed wheel as viewed along the first axial direction.

5. The air conditioning apparatus according to claim 1, further comprising:

a second guide member mounted in the blow-out port opposed space in order to direct air toward the blow-out port after the air is directed to the blow-out port opposed space.

6. The air conditioning apparatus according to claim 5, wherein the second guide member has a second guide body, and the second guide body extends toward the blow-out port so as to continue from a blow-out port side end of the first guide member.

7. The air conditioning apparatus according to claim 2, wherein the first guide member is disposed so as to overlap with the bladed wheel as viewed along the first axial direction.

8. The air conditioning apparatus according to claim 2, further comprising:

a second guide member mounted in the blow-out port opposed space in order to direct air toward the blow-out port after the air is directed to the blow-out port opposed space.

9. The air conditioning apparatus according to claim 3, wherein the first guide member is disposed so as to overlap with the bladed wheel as viewed along the first axial direction.

10. The air conditioning apparatus according to claim 3, further comprising:

a second guide member mounted in the blow-out port opposed space in order to direct air toward the blow-out port after the air is directed to the blow-out port opposed space.

11. The air conditioning apparatus according to claim 4, further comprising:

a second guide member mounted in the blow-out port opposed space in order to direct air toward the blow-out port after the air is directed to the blow-out port opposed space.

* * * * *